US010919658B2

(12) United States Patent
Brunschwiler

(10) Patent No.: US 10,919,658 B2
(45) Date of Patent: Feb. 16, 2021

(54) METHOD FOR THE AUTOMATIC OPENING OF A CARRIER MEANS AS WELL AS AN APPLIANCE FOR CARRYING OUT THE METHOD

(71) Applicant: Ferag AG, Hinwil (CH)

(72) Inventor: Othmar Brunschwiler, Bettwiesen (CH)

(73) Assignee: FERAG AG, Hinwil (CH)

( * ) Notice: Subject to any disclaimer, the term of this patent is extended or adjusted under 35 U.S.C. 154(b) by 159 days.

(21) Appl. No.: 16/126,095

(22) Filed: Sep. 10, 2018

(65) Prior Publication Data

US 2019/0092505 A1 Mar. 28, 2019

(30) Foreign Application Priority Data

Sep. 28, 2017 (CH) ..... 1189/17

(51) Int. Cl.

| | |
|---|---|
| ***B65B 43/18*** | (2006.01) |
| ***B65B 5/08*** | (2006.01) |
| ***B65B 43/36*** | (2006.01) |
| ***B65B 43/30*** | (2006.01) |
| ***B65B 43/54*** | (2006.01) |

(Continued)

(52) U.S. Cl.

CPC ..... *B65B 43/18* (2013.01); *B65B 5/08* (2013.01); *B65B 5/10* (2013.01); *B65B 43/14* (2013.01); *B65B 43/30* (2013.01); *B65B 43/34* (2013.01); *B65B 43/36* (2013.01); *B65B 43/465* (2013.01); *B65B 43/54* (2013.01)

(58) Field of Classification Search

CPC ..... B65B 43/18; B65B 5/08; B65B 43/14; B65B 43/465; B65B 43/54; B65B 43/36

See application file for complete search history.

(56) References Cited

U.S. PATENT DOCUMENTS 3,688,471 A * 9/1972 Clark ..... B65B 43/18 53/571
3,961,461 A * 6/1976 Ruf ..... B65B 39/08 53/571

(Continued)

FOREIGN PATENT DOCUMENTS

| | | |
|---|---|---|
| CH | 417 456 | 7/1966 |
| CH | 709346 | 9/2015 |

(Continued)

OTHER PUBLICATIONS

Switzerland Search Report dated Dec. 12, 2017, Application No. 01189/17, 2 pages.

*Primary Examiner* — Robert F Long
*Assistant Examiner* — Xavier A Madison
(74) *Attorney, Agent, or Firm* — Rankin, Hill & Clark LLP

(57) ABSTRACT

A facility for the automated opening of a carrier and for the provision of the carrier in loading and transport aids, the facility including a carrier feed appliance for feeding flatly closed carrier to a holder of a first conveying appliance, and a first conveying appliance for conveying the flatly closed carrier, which are held the holder, to a carrier opening appliance. The carrier opening appliance opens the flatly closed carrier. A merging appliance brings the carrier into the loading and transport aids. A second conveying appliance transports away the loading and transport aids with the opened carriers, which are arranged in the loading and transport aids.

25 Claims, 11 Drawing Sheets

(51) Int. Cl.

| | |
|---|---|
| ***B65B 43/14*** | (2006.01) |
| ***B65B 5/10*** | (2006.01) |
| ***B65B 43/46*** | (2006.01) |
| ***B65B 43/34*** | (2006.01) |

(56) References Cited

U.S. PATENT DOCUMENTS

| | | | | |
|---|---|---|---|---|
| 5,904,029 | A * | 5/1999 | Amigo | B65B 35/16 53/437 |
| 2004/0055250 | A1* | 3/2004 | Main | B65B 43/18 53/386.1 |
| 2004/0103619 | A1* | 6/2004 | Droog | B65B 43/36 53/459 |
| 2006/0090814 | A1* | 5/2006 | Hayes | B65B 43/54 141/314 |
| 2007/0074492 | A1 | 4/2007 | Koga et al. | |
| 2013/0259405 | A1 | 10/2013 | Jack | |
| 2014/0291123 | A1* | 10/2014 | Olivieri | D06F 95/00 198/617 |
| 2014/0331619 | A1* | 11/2014 | Takahashi | B65B 43/16 53/525 |
| 2015/0291296 | A1* | 10/2015 | Lorger | B65B 43/28 53/459 |
| 2017/0217621 | A1 | 8/2017 | Robinson et al. | |
| 2019/0071258 | A1* | 3/2019 | Ueda | B65G 47/61 |

FOREIGN PATENT DOCUMENTS

| | | |
|---|---|---|
| DE | 41 05 452 | 8/1992 |
| DE | 43 29 179 | 3/1995 |
| DE | 196 07 507 | 9/1997 |
| EP | 2 918 501 | 9/2015 |
| EP | 3 181 462 | 6/2017 |
| GB | 1011276 | 11/1965 |
| WO | 2016/197176 | 12/2016 |

* cited by examiner

METHOD FOR THE AUTOMATIC OPENING OF A CARRIER MEANS AS WELL AS AN APPLIANCE FOR CARRYING OUT THE METHOD

BACKGROUND OF THE INVENTION

Field of the Invention

The present invention generally lies in the field of automated order picking, and relates to a method as well as to an appliance for the automated handling and conveying of a carrier means such as, for example, a carrier bag.

Description of Related Art

Online supermarkets represent an alternative to conventional supermarkets and, accordingly, also offer selection that is common for supermarkets such as, e.g., foodstuffs, body care articles, household articles, stationary, etc. are also becoming increasingly established in the field of online trade.

One advantage of online supermarkets is the fact that the customer can put together his purchase at home or when out and about via an online portal and can have these delivered to his home via a delivery service or have them delivered to a collection point.

The ordered goods are delivered in carrier means, such as, for example, carrier bags, as are also obtainable in conventional supermarkets for packing of purchases at the tills.

Concerning the carrier bags, as a rule these are carrier bags, which are folded together in a flat manner and which firstly need to be opened and folded out before being filled with the purchases.

The order picking of the ordered goods into the carrier means, such as carrier bags, is generally effected in automated logistics centres.

Although the carrier means, such as carrier bags as a rule are durable and have a corresponding tear strength, these are often not robust enough to be conveyed as conveying containers or transport containers along an order picking stretch for the purpose of order picking.

Despite this and for practical reasons, the order picking should be effected directly into the carrier means.

The publication document WO 2016/197176 A1 describes a method for order picking goods into sacks. For the order picking, the sacks are brought into crate-like loading and transport aids. The loading and transport aids support the sacks to the side as well as to the base and in this manner reduce the risk of damage to the sacks, for example on filling the sacks with goods.

Holding-open means ensure that the sacks remain open or do not fold together or collapse again during the order picking.

According to the state of the art, the carrier means such as carrier bags are generally opened and brought into the loading and transport aids in a manual manner.

However, the manual opening of the carrier means as well as the feeding of the transport containers with carrier means is extremely time-consuming and labour-intensive. Furthermore, this is indeed a monotonous, low-qualified activity that is at odds with comparatively high labour costs.

In the state of the art, there are indeed solutions to open carrier bags in an automated method for the purpose of filling with goods.

The publication document EP 2 918 501 A1 describes a method for the automated opening of a flatly folded-together carrier bag. For this, in a first step, the bag base is folded open by way of a suction gripper. In a second step, blow air is blown from above through the bag opening for completely unfolding or folding open the carrier bag.

This method has the disadvantage that the bag opening is still not sufficiently released merely by way of folding over the base. The introduction of blow air is rendered difficult due to this.

SUMMARY OF THE INVENTION

It is now the object of the invention to propose a method as well as an associated appliance for providing and opening carrier means such as carrier bags, in particular folded bags, as well for feeding loading and transport aids, also called loading and transport means, with carrier means, said method taking its course in a fully automatic manner.

The method according to the invention for the automated opening of carrier means and for the provision of the carrier means in container-like loading and transport aids includes the following steps:

feeding flatly closed or pressed-together carrier means, in particular from a stack of flatly closed carrier means, to holding means of a first conveying appliance by way of a carrier means feed appliance;

conveying the flatly closed carrier means, which are held by the holding means, from the carrier means feed appliance to a carrier means opening appliance by way of the first conveying appliance;

opening and unfolding the flatly closed carrier means by way of the carrier means opening appliance;

bringing the carrier means into the loading and transport aids by way of a merging appliance;

conveying away of the loading and transport aids with the opened carrier means, which are arranged in these, by way of a second conveying appliance.

For opening, in particular the flatly closed carrier means are transferred out of the holding means of the first conveying appliance onto the carrier means opening appliance.

The term "flatly closed" in particular means that the carrier means in the closed state are present as flat bodies or are flatly pressed together. The carrier means can therefore, for example, be flatly folded together.

In the opened state, the carrier means in particular includes carrier means walls. In particular, the carrier means furthermore includes a carrier means base in the opened state. The carrier means walls together with the carrier means base form a carrier means interior.

The carrier means further includes a carrier means opening. This forms an access to the carrier means interior.

The carrier means opening corresponds to the filling opening for bringing the goods to be order picked into the carrier means interior.

The carrier means opening is arranged at the top or faces upwards in the suspended or standing position of the carrier means.

The carrier means can be, for example, a foldable or collapsible box. Accordingly, the carrier means walls are designed in a stiff manner.

However, in particular the carrier means is a carrier bag. Accordingly, the carrier means walls are designed in a flexible or supple manner.

The carrier means can consist of paper, cardboard or plastic or include these. The carrier means walls can be constructed in a single-layered manner or also be present as a layer composite.

If the carrier means is of cardboard or includes this, then in particular the carrier means is a box or a carton.

Furthermore, the carrier bags can also be present as fabric bags.

Although in principle the carrier means is not restricted in its size, the invention however relates in particular to carrier means that are provided in trade for the manual transport of goods, in particular purchases—thus for carrying. Such carrier means therefore in particular have a volume of about 10 to 40 litres.

In particular, the carrier means are designed in a manner such that they stand on their own in the opened and in particular in the empty state.

The carrier means can include holding grips for carrying. The holding grips can be attached to the carrier means walls, be recessed into the carrier means walls as opening or holes or be designed as carrier handles which project from the carrier means walls.

The carrier handles can be foldable into the carrier means interior. The carrier handles can be folded out to the outer side of the carrier means wall.

However, the carrier means can also make do without holding grips and for carrying can be gripped for example on the carrier means base and/or on the carrier means walls.

In particular, the carrier means are so called (packaging) containers. The carrier means resp. containers in particular are characterised in that the goods which are order picked into the carrier means are delivered with. resp. in the carrier means, e.g. to the orderer of the goods. In particular the carrier means, resp. the containers are characterised in that the order picked goods are transported with, resp. in the carrier means, resp. containers across the transport systems.

The carrier means, which are designed as a carrier bag, in particular includes a front wall and a rear wall, which lies opposite this, as well as two side walls, which lie opposed one another, and a bag base.

In particular, the side walls form the short or narrow sides of the carrier bag, whereas the front and rear sides form the long or broad sides of the carrier bag.

Concerning carrier bags, which can be flatly folded together or collapsed, the bag side walls in particular each include a longitudinal fold, along which the carrier bags can be folded together in a flat manner. The longitudinal fold extends in the bag side wall, in particular from the bag base up to the bag opening.

The carrier bag further includes a bag opening. This lies opposite the bag base.

In particular, the bag base bears on the front or rear wall, in particular in a folded over manner, in the flatly folded together state of the carrier bag.

Within the framework of the invention, in particular the term "carrier bag" is also used synonymously for the terms "sack", "pouch" or "packet".

In particular, the flatly closed carrier means are separated from the stack and transferred to the holding means by way of a suction gripper.

For this, the suction gripper is moved between the stack and the holding means of the first conveying appliance via a movement mechanism.

The holding means take over or receive the carrier means and hold these for the purpose of further conveying. In particular, the holding means receives an individual carrier means.

In particular, the holding means are grippers, which, according to definition, also include holding clamps or clips. However, the holding means can also be holding hooks, holding needles, holding tabs or parts of a Velcro connection.

According to a further development of the invention, the suction gripper each grips an individual carrier means at a stack face side and moves this into a transfer region. The stack face side can be a stack front side or a stack lower side. The carrier means is transferred in the transfer region from the suction gripper to a holding means.

If the holding means is a gripper, then the suction gripper introduces the carrier means in particular with a carrier means section into the open gripper. The gripper is subsequently closed and grips the carrier means. As soon as the gripper has gripped the carrier means, the suction gripper detaches itself from the carrier means. The suction gripper moves again back to the stack for the purpose of gripping a next carrier means.

In particular, the suction gripper includes at least one suction head. This is connected to a vacuum generator which produces a vacuum at the suction head. The vacuum ensures that the suction gripper can grip the carrier means.

The vacuum is reduced or lifted for detaching or releasing the carrier means from the suction gripper or from the suction head.

The stack can be arranged for example lying on a support (rest) of the carrier means feed appliance. In particular, the front as well as the rear flat side of the stack is supported. The stack can also be laterally supported.

In particular, the holding means are each arranged on a conveying member, which is movable along a conveying stretch. The holding means and the conveying members in each case form a conveying unit. In particular, the conveying member each includes a single holding means.

In particular, the conveying member is a conveying vehicle with (runner) rollers, the vehicle being able to roll along a guide rail.

According to a special embodiment the conveying vehicle can include two vehicle bodies that are arranged one after another and are spaced from each other in the moving direction, resp. in the longitudinal direction of the rail. The vehicle bodies are connected with each other via a strut body, such as a connection brace. The two vehicle bodies in each case contain, in particular, at least one runner roller. Such a conveying vehicle is characterised in by a high stability and smooth running.

In particular, the conveying members are movable along the conveying stretch independently of one another.

In particular, the first conveying appliance is designed as a revolving apparatus, in which the conveying units are conveyed along a closed conveying stretch.

In particular, the holding means are conveyed into the transfer region in a controlled manner via a supply unit for the purpose of the take-over of the flatly closed carrier means. The supply unit serves for the provision of the holding means in the transfer region for transferring carrier means to the holding means. In particular, the supply unit is a screw (worm) conveyor.

The screw conveyor includes a conveying screw, which is rotatable about a rotation axis. A spirally or helically designed guide groove is arranged along the outer periphery of the conveying screw.

The guide groove serves for receiving a catch element such as a catch lug, which is arranged on the conveying member. This element engages into the guide groove and together with the conveying unit is caught along the rotation axis of the conveying screw by way of the guide groove, which rotates with the conveying screw, and is conveyed into the transfer region.

Subsequently to the take-over of the carrier means, the conveying units are conveyed out of the transfer region in particular by the conveying screw.

In particular, a release station is arranged upstream of the screw conveyer considered in the conveying direction, the release station interacting with a control and releasing the conveying units individually into the transfer region.

In particular, the release station serves for releasing individual conveying units into the transfer region in a controlled and, in particular, cycled (paced) manner.

The release station in particular includes a retaining element, which can be switched by way of the control and by way of which the conveying units can be held back upstream of the transfer region considered in the conveying direction. Individual conveying units can be released into the transfer region by way of switching the retaining element between a retaining position and a release position.

In particular, an accumulation stretch is formed upstream of the screw conveyor or of the release station considered in the conveying direction, in which accumulation stretch conveying members with empty holding means are accumulated. In particular, the accumulation stretch runs along a descent.

The carrier means are transferred to the holding means, in particular in a suspended position, in the transfer region. Hereby, a holding means receives an individual carrier means.

The carrier means opening in particular faces upwards. In particular, the carrier means opening is directed towards the holding means.

The flatly closed carrier means are conveyed into the carrier means opening appliance in particular in a suspended manner.

In particular, the conveying units with the flatly closed carrier means are conveyed into an opening region in the carrier means opening appliance in a cycled manner via a pacer. In particular, the conveying units with the flatly closed carrier means are positioned in a certain opening position in the opening region.

The pacer can include a screw conveyor. The screw conveyor includes a conveying screw, which is rotatable about a rotation axis. A spirally or helically designed guide groove is arranged along the outer periphery of the conveying screw.

The guide groove serves for receiving a catch element, such as a catch lug, which is arranged on the conveying member. This catch element engages into the guide groove and together with the conveying unit is caught along the rotation axis of the conveying screw by the guide groove, which rotates with the conveying screw, and is conveyed into the opening region or into the opening position.

Subsequently to the opening and the transfer of the carrier means to the loading and transport aid, the conveying units are conveyed again out of the opening region, in particular by way of the conveying screw.

A release station which interacts with a control and individually releases the conveying units with the flatly closed carrier means into the opening region can be arranged upstream of the screw conveyor considered in the conveying direction.

In particular, the release station serves for releasing individual conveying units with flatly closed carrier means into the opening region in a cycled manner.

In particular, the release station includes a retaining element, which can be switched by the control and by way of which the conveying units can be held back at the entry of the opening appliance considered in the conveying direction. Individual conveying units can be released into the opening region by way of switching the retaining element between a retaining position and a release position.

In particular, an accumulation stretch, in which the conveying units, which are fed with the flatly closed carrier means are accumulated, is formed upstream of the screw conveyor or of the retaining station considered in the conveying direction. In particular, the accumulation stretch runs along a descent.

In particular, the flatly closed carrier means are opened in the carrier means opening appliance in the suspended position.

According to a particular further development of the invention, the carrier means are opened in the carrier means opening appliance in a two-step opening method.

In a first opening step, two carrier means walls of a carrier means which lie opposite one another are separated or pulled apart by way of a separating mechanism. Concerning this step, the carrier means walls are spaced from one another. Herein, at least one opening gap is released or the carrier means opening released, in the region of the closed carrier means opening.

If the carrier means is a carrier bag, then the bag walls that lie opposite one another, in particular, are the bag front wall and the bag rear wall.

The two carrier means walls are separated in particular by way of suction grippers, which are part of the separating mechanism.

For this, the separating mechanism in particular includes at least one first suction gripper for gripping a first carrier means wall and at least one second suction gripper for gripping an opposite second carrier means wall.

For this, before the first opening step, the flatly closed carrier means is brought together with the at least one first and with the at least one second suction gripper in a manner such that the carrier means comes to lie between the at least one first and the at least one second suction gripper.

In particular, the at least one first and at least one second suction gripper are arranged opposite to one another.

The distance between the at least one first and the at least one second suction gripper is reduced for gripping the carrier means walls.

The at least one first and at least one second suction gripper can be accordingly pressed towards one another for gripping the carrier means walls. A counter-holder can be done away with in such a manner.

The mentioned suction grippers grip the carrier means walls, in particular at their outer sides.

For this, in particular, the at least one first or the at least one first as well as the at least one second suction gripper are moved towards the respective outer side of the mentioned carrier means walls. The carrier means walls are gripped by the suction grippers, which approach their outer sides.

With regard to this procedure, the at least one first or the at least one first as well as the at least one second suction gripper are moved towards the opposite suction gripper amid the reduction of the distance between the at least one first and the at least one second suction gripper.

The carrier means walls are spaced from one another amid separation of the carrier means walls after the suction grippers have gripped the carrier means walls. For this, the at least one first or the at least one first as well as the at least one second suction gripper is moved away from the opposite suction gripper.

The mentioned suction grippers can be moved along a linear or arcuate movement path. The suction grippers can therefore be mounted, for example, in a pivotable manner. Combined movement patterns are likewise possible.

In particular, the mentioned suction grippers include at least one suction head. In particular, this suction head is connected to a vacuum generator, which generates a vacuum at the suction head. The vacuum ensures that the suction gripper can grip and hold the carrier means wall.

The vacuum is reduced or lifted for releasing the carrier means wall from the suction gripper or from the suction head.

In particular, the pulling-apart of the carrier means walls serves for the release of a carrier means opening or at least one opening gap of the carrier means opening, through which opening or gap an active means can act for the complete opening of the carrier means, as is yet described hereinafter.

According to a particular embodiment, the suction grippers also serve for the transfer of the carrier means from the first conveying appliance into the loading and transport aid.

For this, the carrier means are transported into the opening region in a manner held by the holding means.

The carrier means are released from the holding means or detached from these, after the suction grippers have gripped the carrier means for the purpose of opening the carrier means. This is effected before bringing the carrier means into the loading and transport aids and in particular before the complete opening of the carrier means. From now on, the carrier means, in particular, are held only by the suction grippers.

The suction grippers are only released from the carrier means again when the carrier means have been brought into the loading and transport aids by way of the merging appliance and are held by these aids or supported to the bottom by them.

In a second opening step, the carrier means are completely opened by way of an active means, which acts through the carrier means opening or through its opening gap into the carrier means interior. The active means is part of an active means mechanism.

If the carrier means is a flatly folded-together carrier bag, then the complete opening of the carrier bag in the second opening step corresponds to a complete folding apart or unfolding of the carrier bag.

On unfolding, in particular a base, which is folded over to the front or rear wall, is also folded out, by which means the complete unfolding of the carrier bag is rendered possible at all.

Specifically, the base does not necessarily need to be folded out on separating the separating walls by way of the separating mechanism.

The active means acts through the carrier means opening, in particular from above into the carrier means interior.

The active means can be an active medium, such as blow air that acts into the carrier means interior or is blown into this.

For this, the separating mechanism includes a blow air system for blowing in the blow air through the carrier means opening or through its opening gap into the carrier means interior. The carrier means is inflated by way of the produced overpressure in the carrier means interior and is completely opened in this manner.

The term "air" here is representative for any suitable gas or gas mixture.

However, the active means can also be an active body, which is brought or introduced into the carrier means interior.

According to this embodiment variant, the active body is brought into the carrier means interior or introduced into this, through the carrier means opening or through its opening gap, in particular from above.

The active body can be for example an inflatable active body, an opening brush, an opening plunger or an opening roller of foam. The opening plunger can include e.g. opening rollers, which can be pivoted out laterally.

The active body has the task of displacing the carrier means walls to the outside amid the complete opening of the carrier means.

Concerning an inflatable active body, this is achieved by way of inflating the active body in the carrier means interior. The volume of the active body is enlarged due to the inflation of this, by which means the carrier means walls are displaced outwards.

In particular, the inflatable active body is flexible. The inflatable active body can be a balloon, a sack or a porous body. The inflatable active body can be inflated or blow up for example by way of a gas, such as air. In particular, the inflatable active body is reversibly inflatable.

Furthermore, it is possible to combine several active means with one another. An improved combination lies in the use of an active medium, such as blow air, together with an active body, such as an opening plunger.

The separating mechanism and the active means mechanism are part of the carrier means opening appliance.

A further aspect of the invention relates to the bringing of the carrier means into the loading and transport aids by way of a merging appliance.

In particular, the carrier means are introduced into the loading and transport aids in the carrier means opening appliance.

In particular, the carrier means are brought into the loading and transport aids in the flatly closed state, which is to say before them being opened.

This means that the carrier means are not opened until these have already been arranged or placed into the loading and transport aids.

However, one can also envisage the carrier means not being brought into the loading and transport aids until subsequently to the opening procedure, which is to say in the opened state.

However, if the dimensions of the receiving space of the loading and transport aids are matched precisely to the outer dimensions of the carrier means, then an accurately fitting placement of the opened carrier means in the loading and transport aids would indeed be found to be difficult and awkward.

In particular, the carrier means are brought into the loading and transport aids in the suspended position.

The carrier means are brought with at least one base-side carrier means section into the loading and transport aids.

In particular, the carrier means are brought into the loading and transport aids in the carrier means opening appliance in their opening position.

According to a further development of the invention, the carrier means are not released from the separating mechanism or its suction grippers until these on the one hand are located in the loading and transport aids and on the other hand are opened.

According to a particular embodiment, the loading and transport aids are moved upwards to the carrier means, which are held in a suspended manner in the carrier means opening appliance, by way of the merging appliance and the carrier means are thus brought into the loading and transport aids.

This means that the carrier means are not moved into the loading and transport aids, but the loading and transport aids are moved to the carrier means.

The merging appliance includes, for example, a support member (rest member) for the loading and transport means. The support member and with this accordingly also the loading and transport aid, which is arranged on the support member, is liftable in the direction of the opening region of the carrier means opening appliance and lowerable again by way of a lifting mechanism.

Subsequently to receiving the carrier means, the loading and transport aids with the opened carrier means, which are brought into these are transferred to the second conveying appliance for further conveying.

The support member together with the loading and transport aid, which is arranged thereon, and the at least one, opened carrier means, which is held therein, in particular is lowered again for this.

In particular, the second conveying appliance serves for order picking goods into the carrier means. For this, the second conveying appliance conveys the loading and transport aids with the opened resp. open carrier means, which are arranged in these, in particular past individual order picking stations.

In particular, the opened resp. open carrier means are conveyed in a standing manner in the second conveying appliance. For this, the carrier means in particular rest on a support of the loading and transport aids via a carrier means base.

According to an alternative embodiment the open carrier means are conveyed in the second conveying appliance in an inclined position relative to a vertical line. For this, the carrier means in particular rest on a support of the loading and transport aids via a carrier means wall, such as bag front wall and bag rear wall, and as the case may be also via a carrier means base.

According to a further alternative embodiment the open carrier means are conveyed in the second conveying appliance in a lying position. For this, the carrier means in particular rest on a support of the loading and transport aids via a carrier means wall, such as bag front wall and bag rear wall.

The second conveying appliance for the further conveying of the loading and transport aids with the opened resp. open carrier means, which are led along in these, according to a first embodiment can form a conveying support (conveying rest) for the loading and transport aids.

Accordingly, the loading and transport aids with the opened carrier means are conveyed away lying on the conveying support.

The conveying support can be actively driven. The conveying support can be formed by a roller track, a conveying band, one or more conveying straps, a mat chain or a modular mat chain or by way of conveying plates.

According to a second embodiment variant, the second conveying appliance is designed as a suspended conveyor (overhead conveyor). The loading and transport aids and hence also the open carrier means arranged in the loading and transport aids are conveyed in a suspended manner according to this embodiment.

For this, the loading and transport aids can be connected directly or indirectly to a conveying member in particular via holding means, resp. via a suspension.

The holding means can, for example, form a support, on which the loading and transport aid lies in the suspended conveying. In this case the loading and transport aids is conveyed indirectly in a hanging manner.

The support can be designed as an open or closed structure. Hence, the support can be, e.g., a support base, a grating or a rod assembly.

The holding means can contain lateral guides, which form a lateral boundary for the loading and transport aids. The lateral guides can e.g. be (side) walls, gratings or rod assemblies.

In particular, the holding mean can itself form a receiving container, such as a transport grating.

The support or the receiving container can be connected to the conveying member via a suspension, such as a rod link.

However, according to an alternative embodiment, the holding means can also merely have a suspension, e.g. a rod-link, via which the loading and transport aid is fastened in a suspended manner. This means that the base of the loading and transport aid is not supported to the bottom. In this case the loading and transport aids are conveyed in a directly hanging manner.

The carrier means are conveyed in an indirectly hanging manner. In other words, the carrier means are arranged in the loading and transport aid during conveyance as mentioned above, whereas the loading and transport aids are conveyed in an directly or indirectly hanging manner.

The conveying member is led, for example, along a guide rail. The conveying member can include a conveying vehicle with runner rollers.

In particular, the guide rail runs along an order picking stretch.

Accordingly, the loading and transport aid and in particular also the carrier means arranged in the loading and transport aid are arranged underneath the conveying member resp. underneath the guide rail.

Accordingly, the loading and transport aids with the opened resp. open carrier means are conveyed in a suspended manner.

Here, the order picking into the opened resp. open carrier means is effected in the suspended position.

The loading and transport aid is characterised by a receiving space for receiving at least one carrier means. The receiving space however does not need to be closed.

For this, the loading and transport aid contains a support (rest), such as a base.

Further, the loading and transport aid in particular contains lateral guides, such as lateral walls.

In particular the receiving space of the loading and transport aid is limited by the support and the side guides.

The loading and transport aid supports the at least one carrier means, in particular to the support resp. base.

The opened, resp. open carrier means are arranged in the loading and transport aid in particular in a standing manner. For this, the carrier means rest on the support of the loading and transport aid, in particular via a carrier means base.

In particular, the loading and transport aid also laterally supports the at least one carrier means via the lateral guides.

For this, the carrier means stands with its carrier means base in particular in the loading and transport aid. As described further below, the carrier means can also be arranged in the loading and transport aid in an inclined or lying manner.

The height of the lateral guides resp. of the lateral walls of the loading and transport aid can correspond to the height of the (lateral) walls of the carrier means.

The height of the lateral guides resp. of the lateral walls of the loading and transport aid can also be higher than the height of the (lateral) walls of the carrier means.

The height of the lateral guides resp. of the lateral walls of the loading and transport aid can be lower than the height of the (lateral) walls of the carrier means, so that the carrier means extend beyond the lateral guides, resp. lateral walls of the loading and transport aid.

In particular, the loading and transport aid is a container or transport container. Within the framework of the invention, the term "container" in particular is also to include a "crate", a "box" a "carton", a "vessel", a "trough", a "tray", a "grating" or a "basket".

The loading and transport aid can consist of cardboard, plastic, metal or wood or include these.

In particular, the loading and transport aids are stackable.

The base or the side walls of the loading and transport aid can be closed or include openings. In the latter case, the loading and transport aid can be constructed in a basket-like or grating-like manner.

In particular, the loading and transport aid essentially has the shape of a cuboid. However, it can also have a different shape.

The loading and transport aid can include an information carrier, such as RFID label, bar code or a QR code, which can be read out in an electronic or optoelectronic manner and which includes identification information on the loading and transport aid. The path of the loading and transport aid and therefore also of the goods which are carried with this along the logistics chain can be tracked by way of this.

The loading and transport aid can be designed for receiving precisely one opened carrier means or several opened carrier means, such as, e.g., two or three carrier means.

In particular, several opened carrier means are arranged next to one another in the loading and transport aid.

In particular, the dimensions of the receiving space of the loading and transport aid are designed to precisely match the outer dimensions of the singular carrier means or of the several carrier means. The singular carrier means or the several carrier means is/are held in the loading and transport aid in a slip-free manner by way of this.

If the loading and transport aid is designed for receiving several carrier means, such as, e.g., three carrier means, then one can envisage a corresponding number of carrier means being positioned in accordingly defined opening positions, in particular next to one another, in the carrier means opening appliance, per opening procedure. The carrier means are hereby opened in groups and in particular simultaneously.

The carrier means are accordingly inserted into the carrier means in groups, in particular with one another.

The carrier means, which are to be opened or are opened, can be brought into the loading and transport aid in a positionally accurate manner by way of this.

In particular, the loading and transport aids serve the following purposes:

they serve as a conveying member on order picking goods;

they provide lateral support for the carrier means, by which means a lateral bending away or kinking of the carrier means, in particular on filling the carrier means with goods, or a lateral breaking of the goods through carrier means walls which tear open, can be prevented;

they support the carrier means base to the bottom, in particular in an extensive (surfaced) manner, so that no goods can break through a base which tears open, particularly if these are thrown with momentum into the carrier means;

they protect at least a lower carrier means region from damage due to external action/effects;

they relieve the carrier means in general, so that these are loaded to a lesser extent at least during the order picking as well as delivery;

they serve as transport means on delivering the goods subsequently to the order picking.

The invention moreover relates to a facility for the automated opening of carrier means and the supply of carrier means in loading and transport aids, in particular for carrying out the method which is described above.

The facility comprises:

a carrier means feed appliance for feeding flatly closed carrier means from a stack to holding means of a first conveying appliance;

a first conveying appliance for the in particular suspended conveying of the flatly closed carrier means, which are held by the holding means, from the carrier means feed appliance to a carrier means opening appliance;

a carrier means opening appliance for opening and unfolding the flatly closed carrier means;

a merging appliance for bringing the carrier means into loading and transport aids;

a second conveying appliance for transporting away the loading and transport aids with the opened carrier means, which are arranged in these.

A further aspect of present invention is directed to a facility for order picking of goods into carrier means, containing a conveying appliance with a plurality of loading and transport aids for receiving of carrier means for the purpose of conveying the carrier means along an order picking stretch, further containing a plurality of individual delivery stations arranged along the order picking stretch for delivery of goods into the carrier means.

According to this aspect of the invention, the conveying appliance is a suspended conveyor (overhead conveyor), by which the carrier means, which are arranged in the loading and transport aids, can be conveyed in a hanging manner along the order picking stretch.

In particular, the conveying appliance corresponds to the second conveying appliance according to the second embodiment variant, which is described further above.

In particular, the loading and transport aids corresponds to the loading and transport aids, such as e.g. transport container, which are described further above.

The arrangement of the open carrier means in the loading and transport aids in particular corresponds to the arrangement of the opened carrier means in the loading and transport aids as disclosed in connection with the opening appliance. This also concerns the accurately fitting placement of the opened carrier means in the loading and transport aids according to a further development of the invention.

Accordingly, a loading and transport aid can be designed, as disclosed above, for receiving only a single or several or in particular three open carrier means.

The carrier means correspond to the carrier means as disclosed further above and can be, for example, carrier bags.

Further, this aspect of the invention is also directed to a method for order picking goods in carrier means by means of the above described facility, wherein according to the method the carrier means are conveyed via the loading and transport aids along the order picking stretch past the individual delivery stations in a hanging manner.

The carrier means are conveyed in the loading and transport aids along the order picking stretch in an open state. The carrier means opening in particular faces upwards.

In case of a standing conveyance of the carrier means the carrier means opening is facing upwards. The delivery stations along the order picking stretch are designed and arranged such that the goods are delivered from above through the carrier means opening into the carrier means. The goods can fall in an unguided manner into the carrier means.

In case of an inclined conveyance of the carrier means, the carrier means opening is oriented at an upwards-facing angle. The delivery stations along the order picking stretch are designed and arranged such that the goods are delivered through the carrier means opening into the carrier means from slanted from above. The goods can glide along a resting carrier means (bag) wall into the carrier means.

In both cases the delivery of the goods takes place in particular with the support of gravity.

In case of a lying conveyance of the carrier means the carrier means opening is directed sideways. The delivery stations along the order picking stretch are designed and arranged such that the goods are delivered through the carrier means opening into the carrier means from the side. The goods can be pushed from the side through the carrier means opening into the carrier means The loading and transport aids can be removed or released from the holding means together with the filled carrier means contained therein after finishing of the order picking process and can be transferred to a further facility for carrying out subsequent process steps.

The further facility can also include a conveying appliance. The conveying appliance can include an endless (revolving) circulating conveying surface, on which the loading and transport aids with the filled carrier means contained therein rest. The moved conveying surface can be conveyor belt, a module belt chain or a plate chain.

In particular, the present invention is applied in logistics centres of online supermarkets.

The present invention permits the fully automated supply and opening of carrier means as well as the fully automated bringing of the carrier means into the loading and transport aids. The feasibility of order picking facilities is increased and labour costs reduced thanks to the invention.

The subject-matter of the invention is hereinafter explained in more detail by way of embodiment examples which are represented in the accompanying figures. In each case in a schematic manner:

Figure 4A:
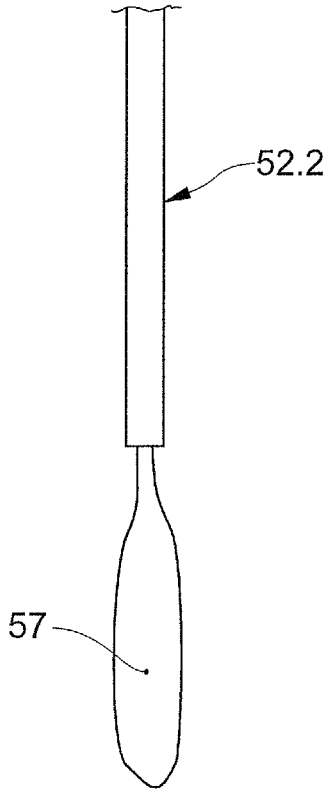
Figure 4B:
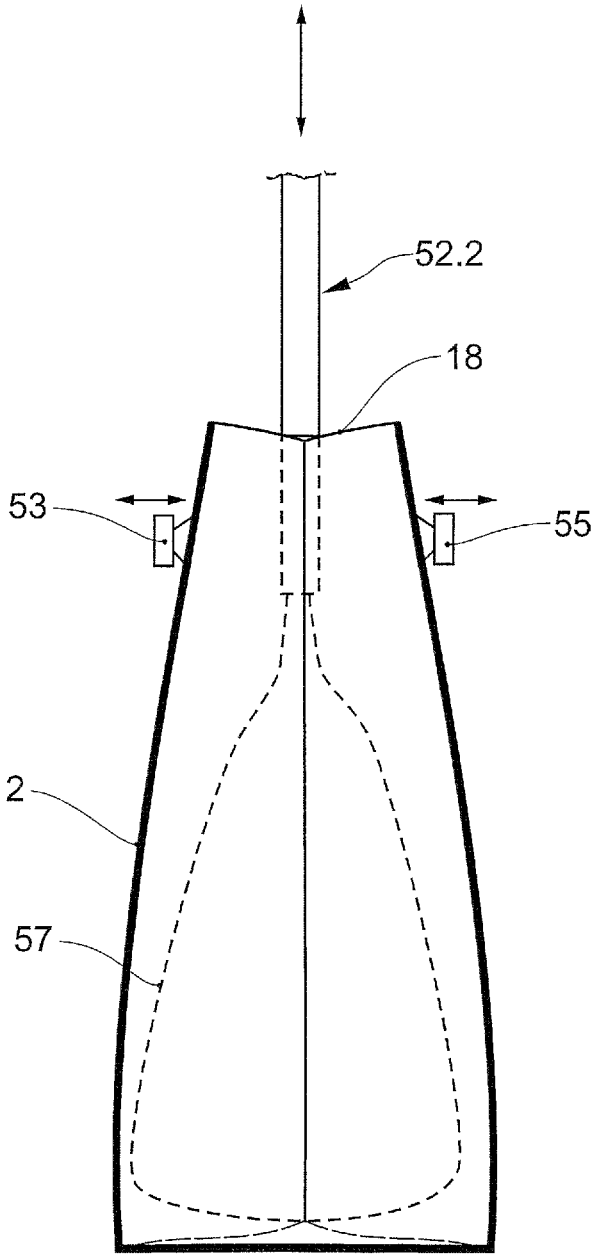
Figure 5A:
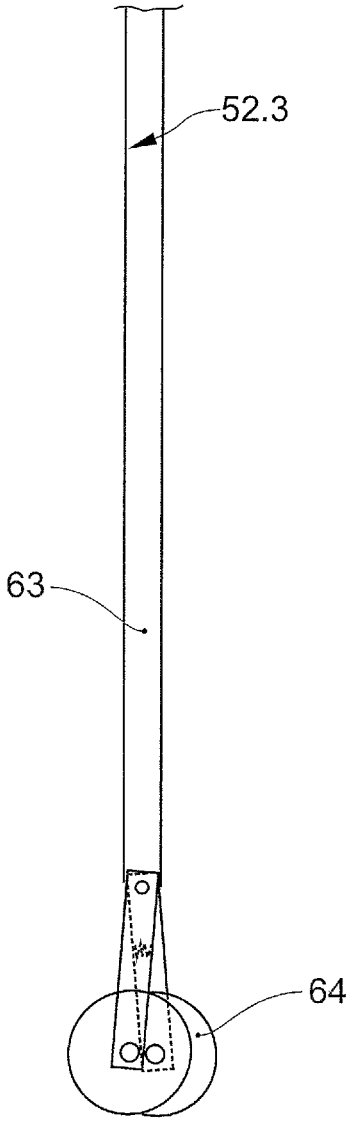
Figure 5B:
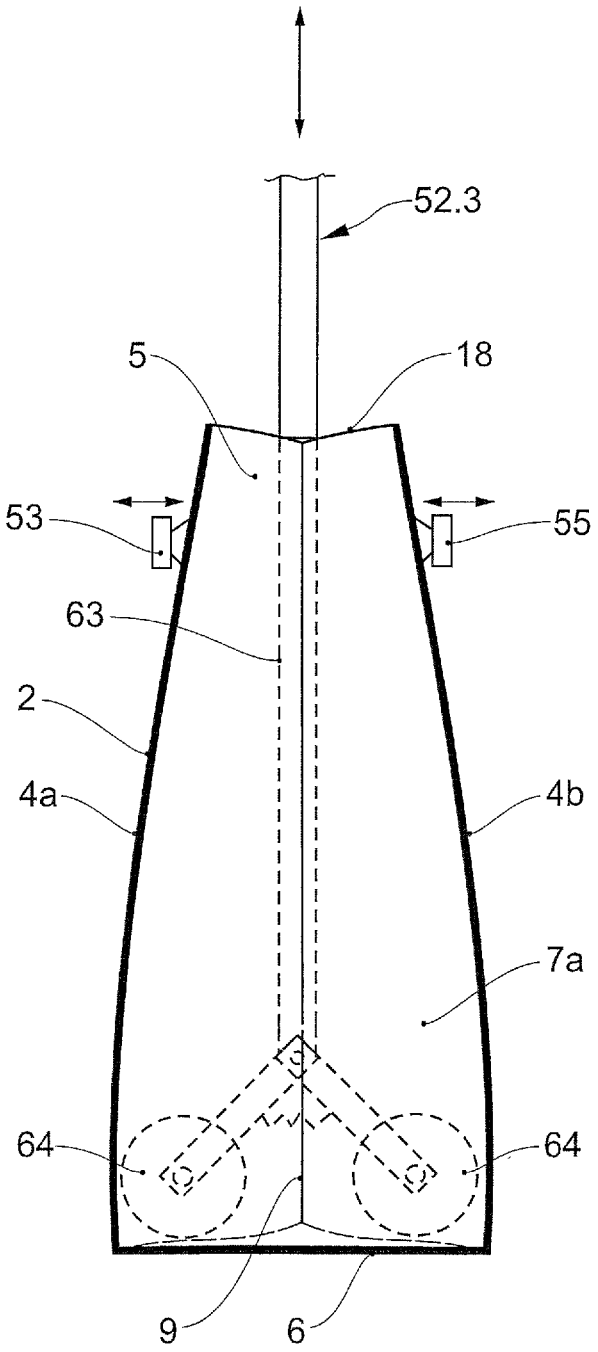
Figure 6:
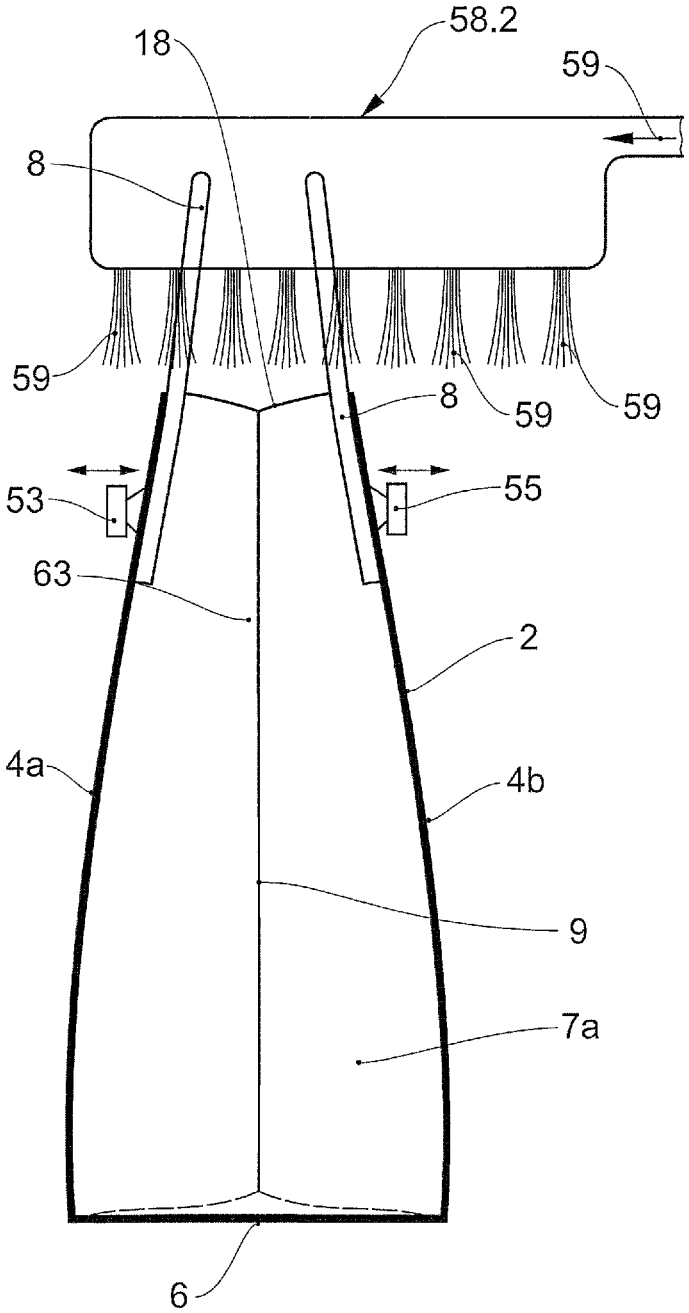
Figure 7:
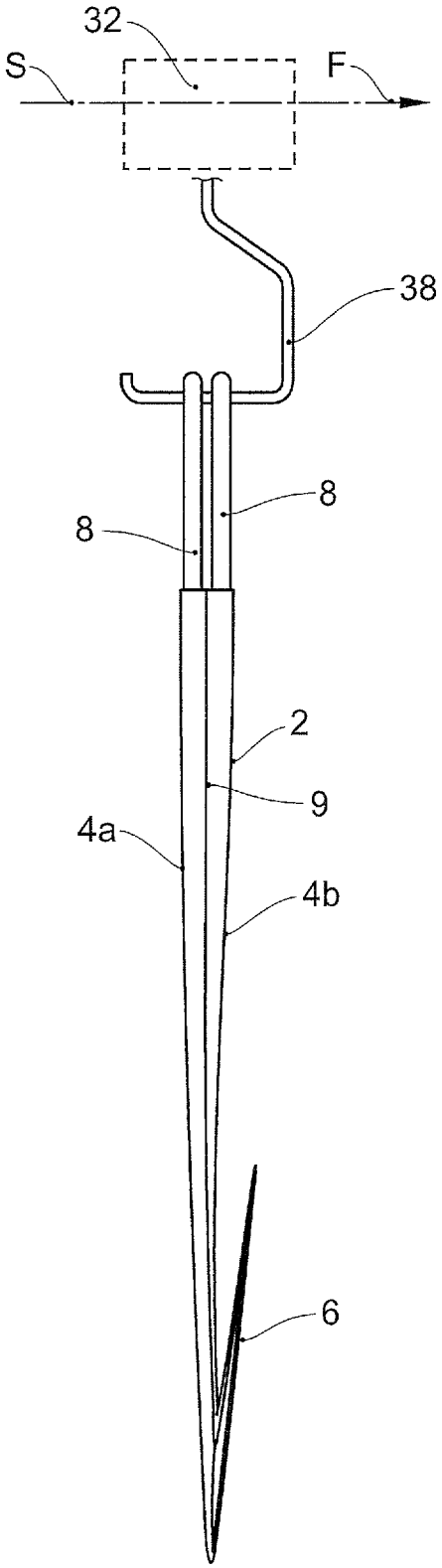
Figure 8:
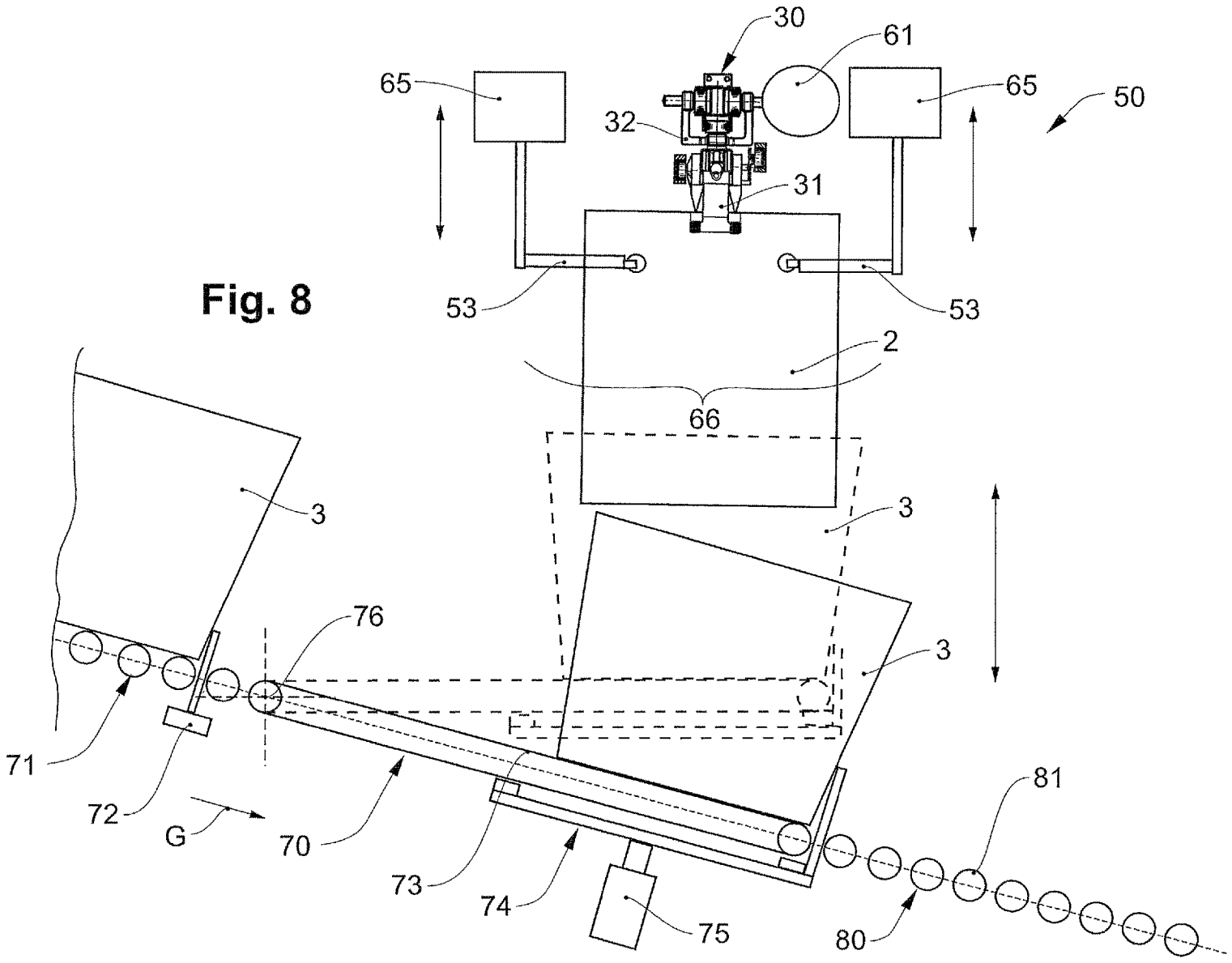
Figure 9D:
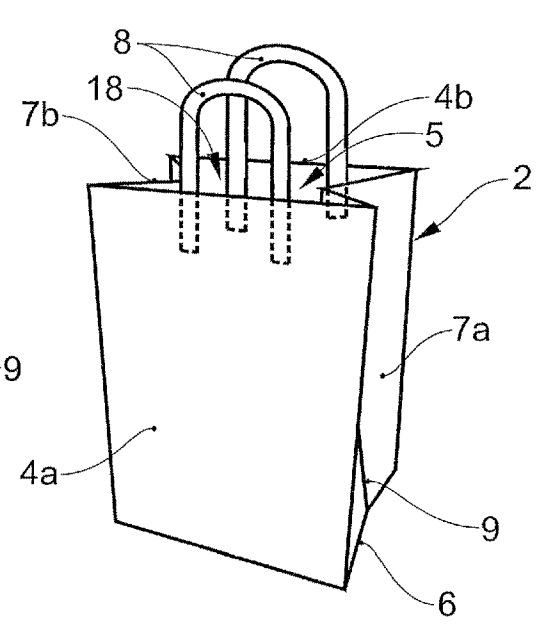
Figure 9C:
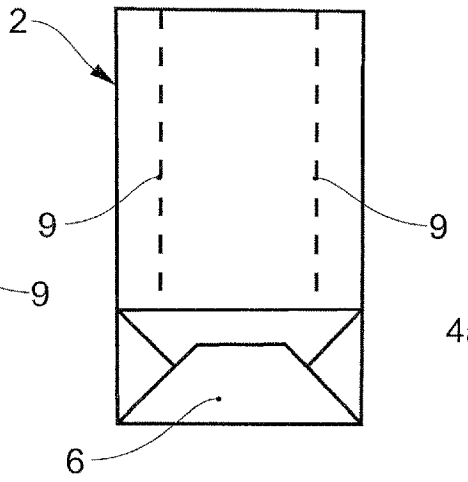
Figure 9B:
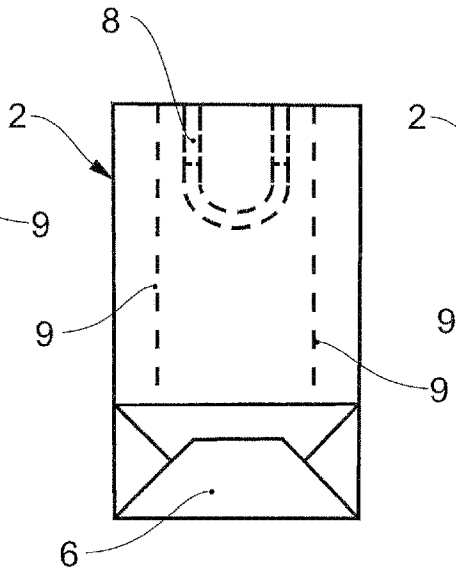
Figure 9A:
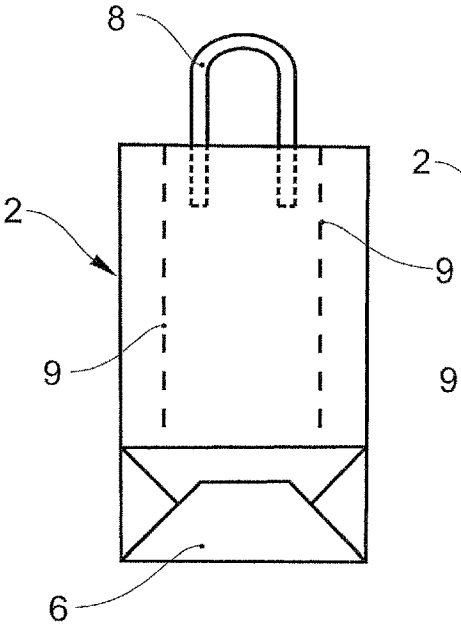
Figure 12:
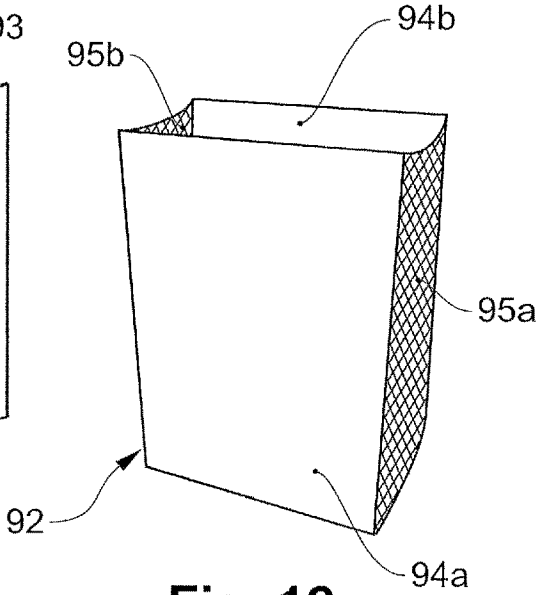
Figure 11B:
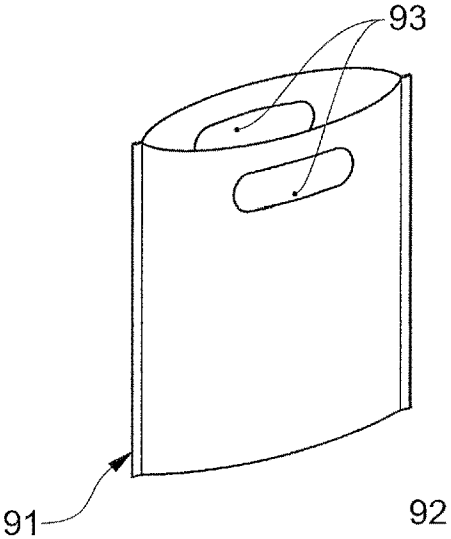
Figure 11A:
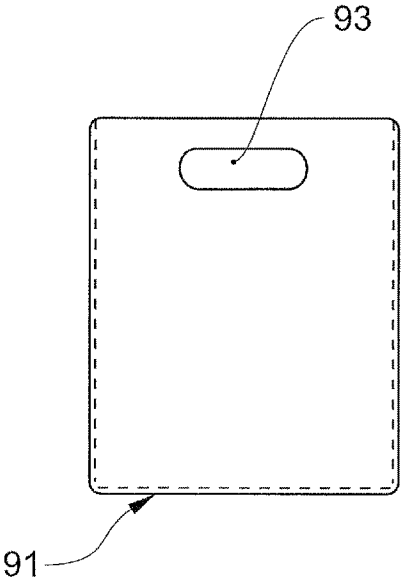
Figure 10:
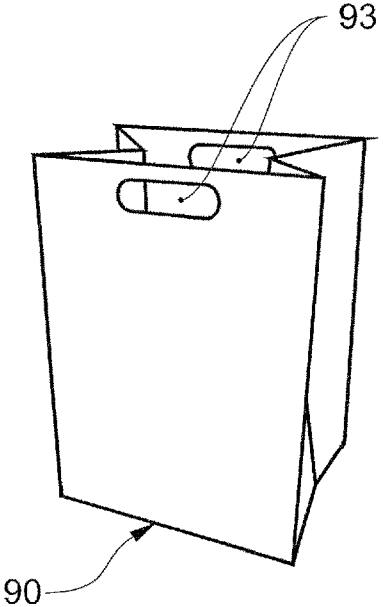
Figure 13:
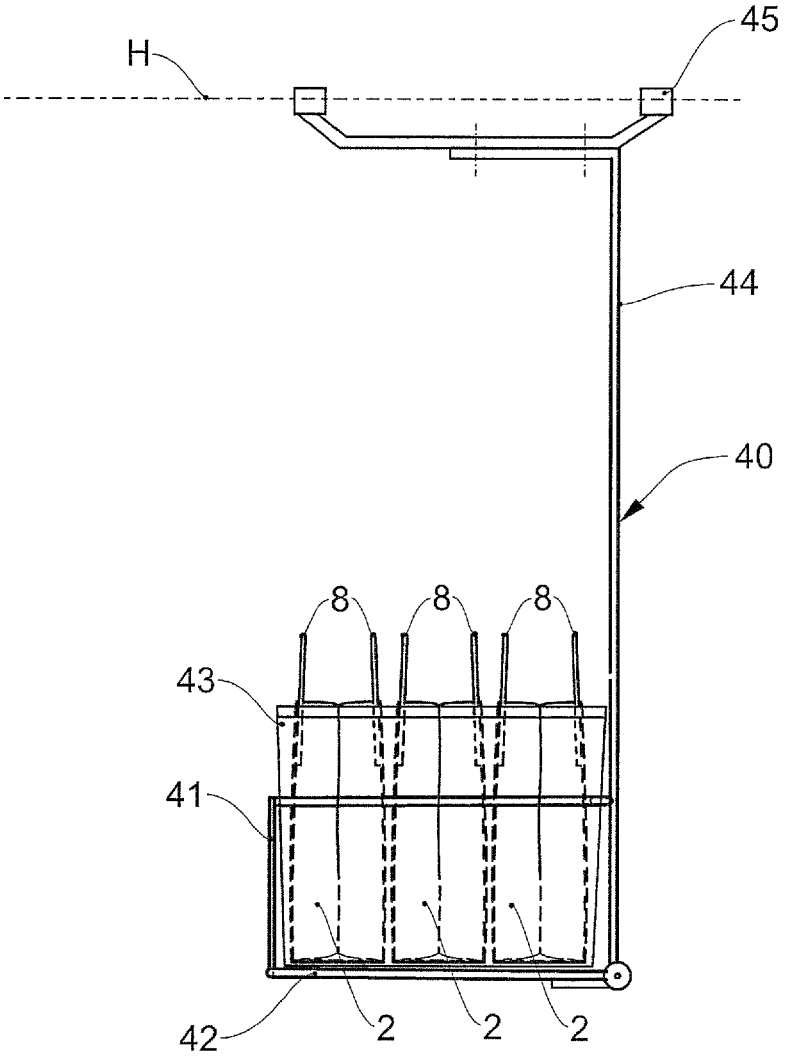
Figure 14:
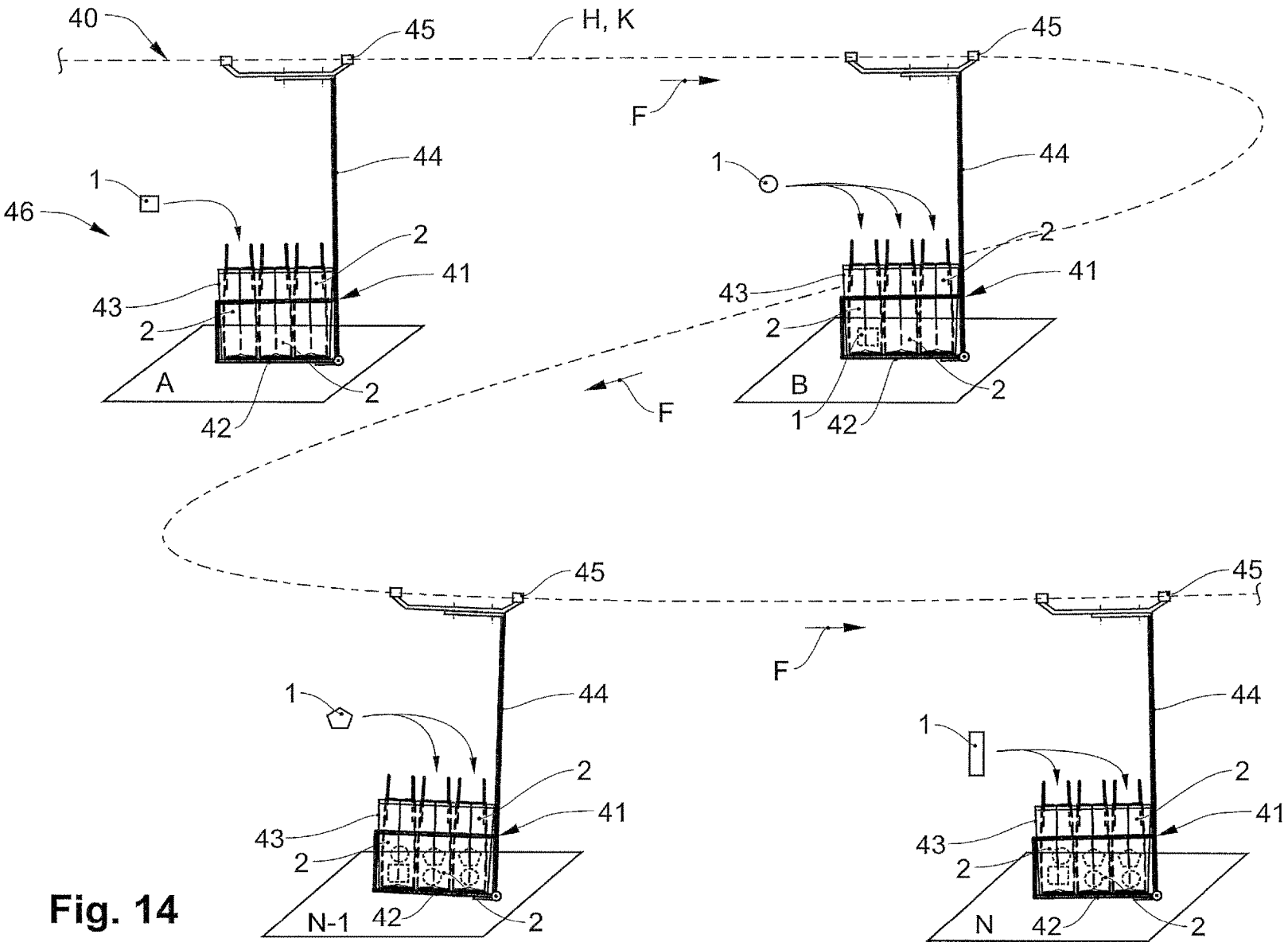

FIG. 4*a*-4*b* shows lateral views of an active means mechanism;

FIG. 5*a*-5*b* shows lateral views of a further active means mechanism;

FIG. 6 shows a lateral view of a further bag opening mechanism;

FIG. 7 shows a lateral view of a holding means which is designed as a hook;

FIG. 8 shows a lateral view of a merging appliance;

FIG. 9*a*-9*d* shows various views of a carrier bag;

FIG. 10 shows a perspective view of a further carrier bag;

FIG. 11*a*-11*b* shows different views of a further carrier bag;

FIG. 12 shows a perspective view of a further carrier bag;

FIG. 13 shows a view of a further embodiment of a second conveying appliance;

FIG. 14 shows a view of an appliance for order-picking of goods according to a further aspect of the invention.

DETAILED DESCRIPTION OF THE INVENTION

Basically, in the figures, the same parts are provided with the same reference numerals.

Certain features are not represented in the figures for the purpose of a better understanding of the invention. The embodiment examples that are described hereinafter are merely exemplary for the subject-matter of the invention and have no limiting effect.

Figure 1:
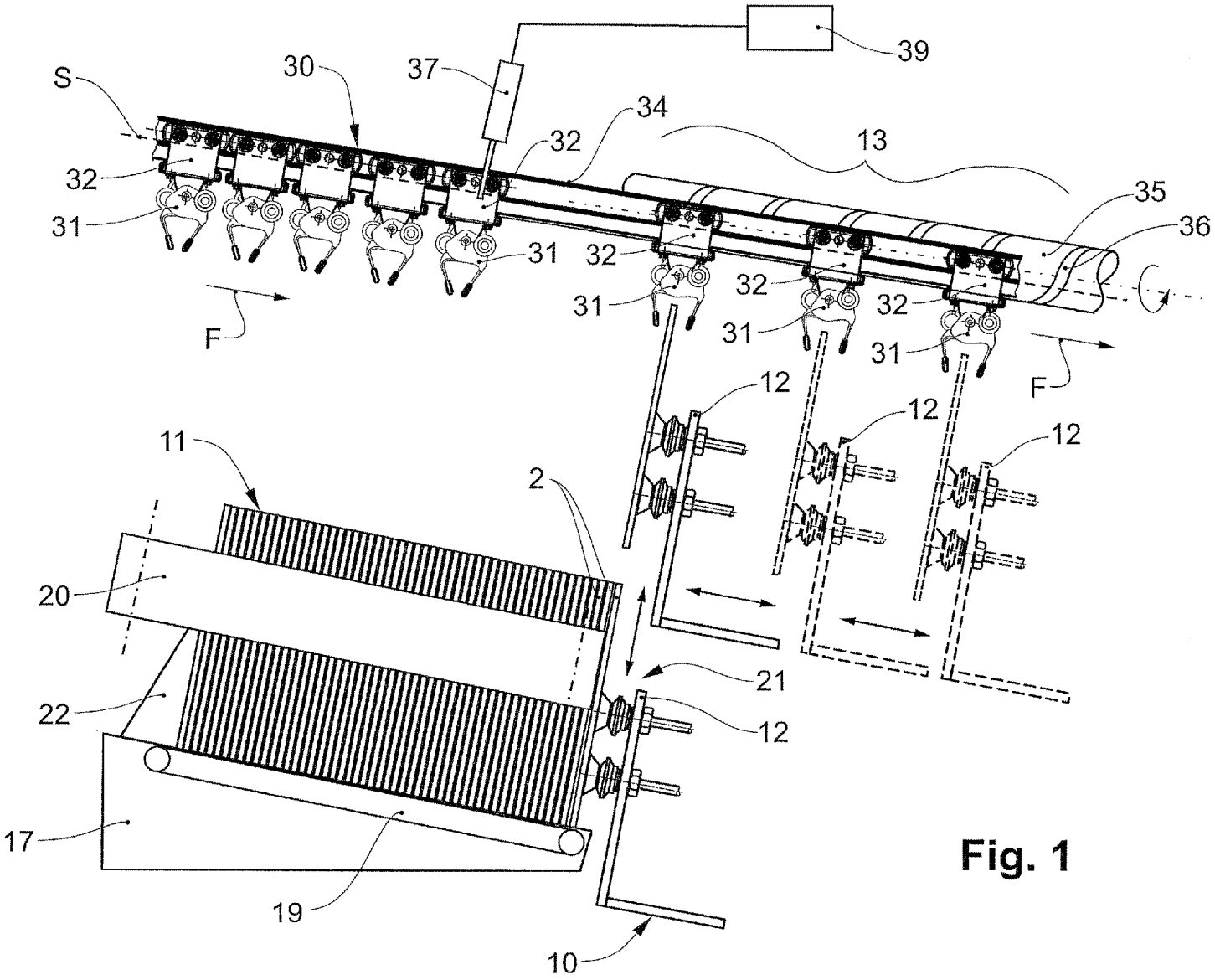
FIG. 1 shows a lateral view of a bag feed appliance.

FIG. 1 shows a lateral view of a bag feed appliance 10 and of a first conveying appliance 30 as well as of the commonly formed transfer region 13.

The bag feed appliance 10 includes a stack guide 17, in which a stack 11 of flatly folded-together carrier bags 2 is arranged in a lying manner. The stack 11 lies in the stack guide 17 on a stack support (rest) 19 which is designed as a conveying belt. The conveying belt permits the active refeed of the stack 11 towards a bag removal location 21.

The stack 11 or the stack support 19 is inclined slightly obliquely downwards towards the bag removal location 21. The inclination assists in the active re-feeding of the stack 11 towards the bag removal location 21.

The stack 11 is supported at its rear flat side by a support member 22. The stack 11 is further also laterally supported by lateral support members 20. The lateral support members 20 are each designed as a conveying belt in this embodiment example. These likewise assist in the active refeed of the stack to the bag removal locations.

The front flat side of the stack 11 is likewise supported on the bag removal location 21, but in a manner such that this permits the removal of individual carrier bags 2 from the stack 11.

The bag feed appliance 10 further includes a suction gripper 12 with several suction heads for removing individual carrier bags 2 from the stack 11. The suction grippers 12 can be moved between the stack 11 and the grippers 31 of the first conveying appliance 30 (see movement arrows) via a movement mechanism (not shown).

The first conveying appliance 30 is a suspended conveyor and includes a multitude of conveying units each with a conveying vehicle 32 as well as with a gripper 31 which is arranged on the conveying vehicle 32.

The conveying vehicles 32 include runner rollers (not shown), by way of which the conveying vehicle 32 rolls along a guide rail 34. The guide rail 34 forms a closed circulating track for the conveying units.

A conveying screw 35 is arranged in the transfer region 13, wherein this conveying screw is rotatably mounted about a rotation axis and by way of which empty conveying units are conveyed into a transfer position in the transfer region 13 in a controlled manner for the purpose of taking over flatly folded-together carrier bags 2.

For this, a spirally or helically designed guide groove 36, which serves for receiving and for driving a catch lug (not shown), which is arranged on the conveying vehicle 32 is arranged along the outer periphery of the conveying screw 35.

The catch lug engages into the guide groove 36 and together with the conveying unit is caught or driven along the rotation axis of the conveying screw 35 and conveyed into the transfer region 13 by way of the guide groove 36, which rotates with the conveying screw 35, for conveying the conveying unit into the transfer region 13.

A release station 37, which interacts with a control 39, is arranged upstream of the conveying screw 35 considered in the conveying direction F.

Individual conveying units are released, which is to say freed into the transfer region 13, in particular in a cycled manner, by way of the release station 37.

The release station 37 includes a retaining element, which can be switched by the control 39 and by way of which the conveying units are held back upstream of the transfer region 13 considered in the conveying direction F. Individual conveying units are released into the transfer region 13 by way of switching the retaining element between a retaining position and a release position.

Furthermore, an accumulation stretch, in which conveying vehicles 32 with empty grippers 31 are accumulated is formed upstream of the release station 37 considered in the conveying direction F. The accumulation stretch runs along a descent.

In each case, a conveying unit is released into the transfer region 13 by way of the release station 37 for the transfer of folded-together carrier bags 2 to empty grippers 31 of the first conveying appliance 30. Furthermore, the suction gripper 12 of the bag feed appliance 10 is led to the front flat side of the stack 11. This with its suction heads grips the frontmost carrier bag 2 at its free flat side.

The suction gripper 12 pulls the gripped carrier bag 2 from the stack 11 and transports this to the open gripper 31 of the conveying unit in the transfer region 13 (see movement arrows). The suction gripper 12 introduces the flatly folded-together carrier bag 2 with an upper bag section into the open gripper jaw of the gripper 31. The gripper 31 is closed and grips the carrier bag 2 in a suspended position.

As soon as the gripper 31 has gripped the carrier bag 2, the suction gripper 12 detaches itself again from the carrier bag 2 and moves back to the stack 11 for the purpose of gripping and removing a next carrier bag 2 from the stack 11 (see movement arrows). A new transfer cycle begins.

The conveying units can be released into the transfer region 13 individually or in groups. Accordingly, individual grippers 31 or a group of grippers 31 can be fed with carrier bags 2 in the transfer region 13.

Subsequently to the take-over of the carrier bags 2, the conveying units in the suspended position are moved in the conveying direction F out of the transfer region 13 by way of the conveying screw 35. Consequently, the conveying units, which are charged with the folded-together carrier bags 2, are conveyed to a bag opening appliance 51 in a suspended manner.

If a group of conveying units are to be fed with carrier bags 2 in the transfer region 13, then in particular the conveying units are also fed in groups to the bag opening appliance 51. The number of conveying units of a group of conveying units hereby corresponds in particular to the number of carrier bags 2, which in the opening region 66 are to be transferred to an individual loading and transport container 3.

Figure 2:
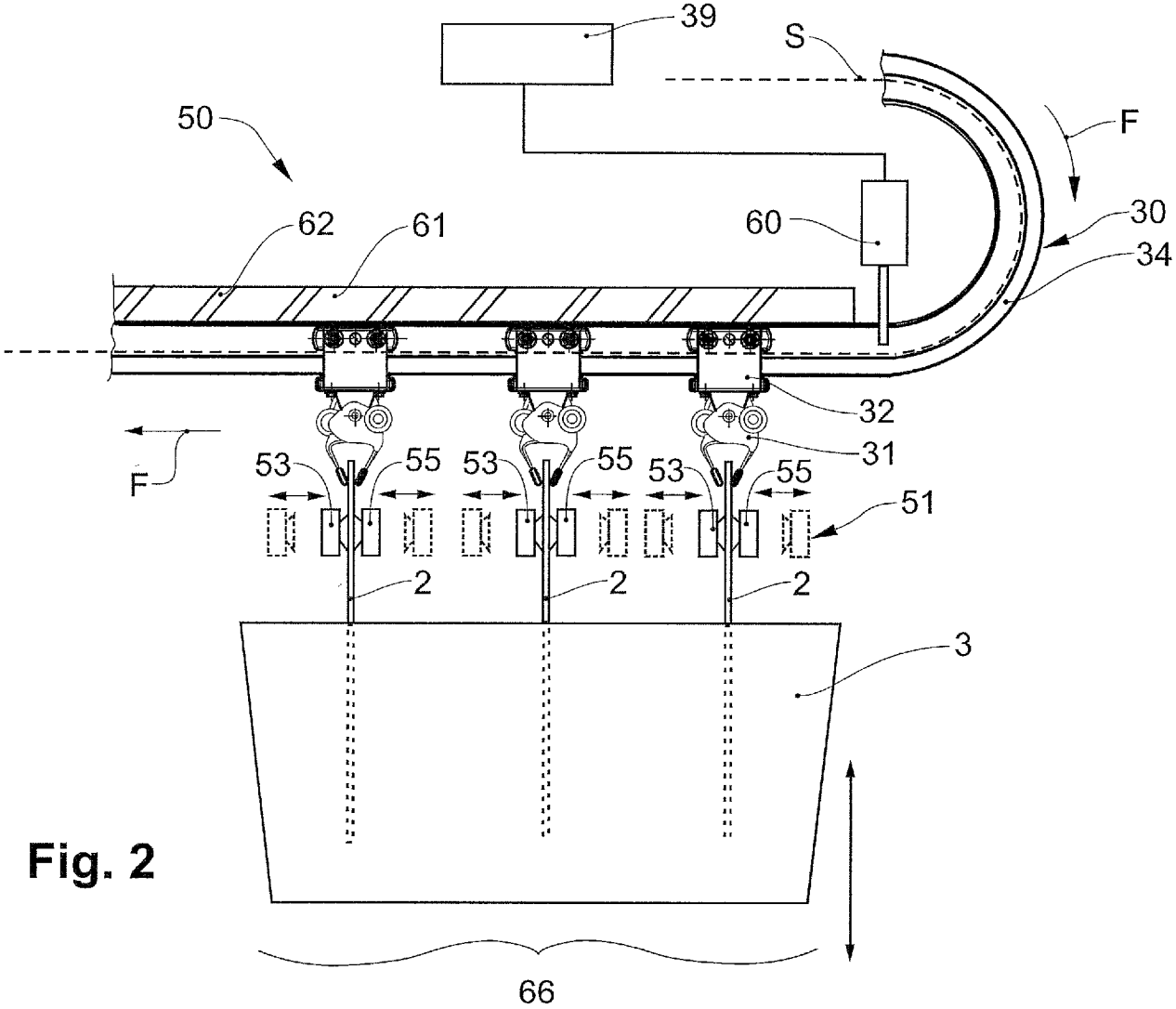
FIG. 2 shows a lateral view of a bag opening appliance.

The already mentioned bag opening appliance 51 according to FIG. 2 forms an opening region 66, in which the carrier bags 2 are opened and brought into the loading and transport container 3.

The bag opening appliance 51 includes a conveying screw 61, which is rotatable about a rotation axis and by way of which conveying units with flatly folded-together carrier bags 2 are conveyed into an opening position in the opening region 66 in a controlled manner.

For this, a spirally or helically designed guide groove 62, which serves for receiving and driving a catch lug (not shown), which is arranged on the conveying vehicle 32, is arranged along the outer periphery of the conveying screw 61.

For conveying a conveying unit in the opening region 66, the catch lug engages into the guide groove 62 and together with the conveying unit is caught along the rotation axis of the conveying screw 61 and conveyed into the opening position by way of the guide groove 62, which rotates with the conveying screw 61.

A release station 60 is arranged upstream of the conveying screw 61 considered in the conveying direction F, the release station interacting with the control 39.

Individual conveying units are released or freed into the opening region 66 in a controlled, in particular cycled manner by way of the release station 60.

The release station 60 includes a retaining element, which can be switched by the control 39 and by way of which the conveying units can be held back upstream of the opening region 66 considered in the conveying direction F. Individual conveying units are released or freed into the opening region 66 by way of switching the retaining element between a retaining position and release position.

Furthermore, an accumulation stretch, in which conveying units with folded-together carrier bags 2 can be accumulated, is formed upstream of the release station 60 considered in the conveying direction F.

The flatly folded-together carrier bags 2 are conveyed into the opening region 66 in the suspended position and are opened.

The opening of the carrier bags 2 in the opening region 66 is effected in a two-step opening method.

For this, the bag opening appliance 50 includes a separating mechanism 51. This includes a first suction gripper 53 and a second suction gripper 55, which lie opposite this, each with at least one first and at least one second suction head 54, 56 respectively, the suction heads being directed towards one another. Both suction grippers 53, 55 form a receiving gap for a carrier bag 2.

Figure 3:
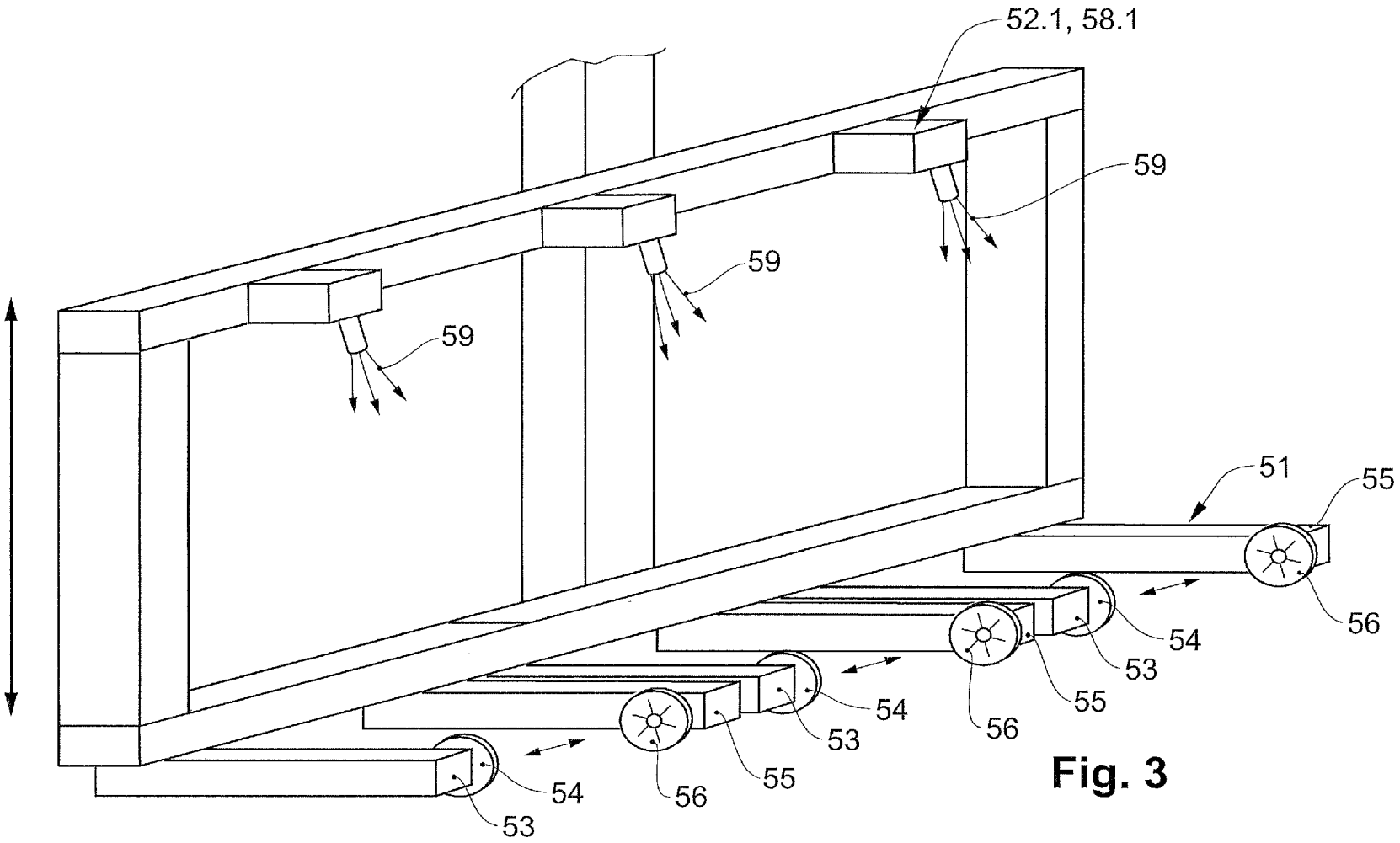
FIG. 3 shows a perspective view of the opening mechanism of the bag opening appliance.

The suction grippers 53, 55 are arranged on a carrier mount (see FIG. 3).

The suction grippers 53, 55 are movably mounted via a movement mechanism. The suction grippers 53, 54 can be moved towards the carrier bags 2 in the opening position by way of the movement mechanism, in a manner such that the carrier bags 2 each come to lie between the first and the second suction gripper 53, 55.

In the present embodiment example, three carrier bags 2 are opened in groups and are transferred to a loading and transport container 3.

Accordingly, three carrier bags 2 are conveyed in the bag opening appliance into opening positions, which are arranged next to one another.

The separating mechanism 51 then includes three pairings of first and second suction grippers 53, 55, which have been mentioned above and which are moved towards the carrier bags 2 in a manner such that the carrier bags 2 each come to lie between a first and a second suction gripper 53, 55 of a suction gripper pairing.

The suction grippers 53, 55 are moved towards one another amid the reduction of the receiving gap between the suction grippers 53, 55 for carrying out a first opening step. Basically, also only one of the suction grippers 53, 55 can be moved to the opposite suction gripper 53, 55.

The suction grippers 53, 55 approach the front and rear wall 4*a*, 4*b* of the carrier bag 2 and grip these with their suction heads 54, 56 which act upon the bag walls 4*a*, 4*b* and hold these.

The carrier bags 4*a*, 4*b* are released from the grippers 31 of the first conveying appliance 30 after the suction grippers 53, 55 have gripped the carrier bags 4*a*, 4*b*. The carrier bags 2 are consequently only then held by the suction grippers 53, 55.

The suction grippers 53, 55 are connected to a vacuum generator 65 for producing a vacuum (see FIG. 8).

After gripping the bag walls 4*a*, 4*b*, the suction grippers 53, 55 are moved away from one another again amid the enlargement of the receiving gap, by which means both bag walls 4*a*, 4*b* are separated from one another while releasing a bag opening 18 or at least one opening gap (see also FIG. 6).

An active means 59 can now act into the bag interior 5 through the released bag opening 18 or through the opening gap, for the purpose of carrying out the second opening step. The active means 59 is part of an active means mechanism 52.1.

The second opening step includes the complete opening or unfolding of the carrier bag 2.

According to the embodiment example according to FIG. 3, the active means mechanism 52.1 includes a blow air system 58.1, by way of which blow air 59 is blown through the bag opening 18 into the bag interior 5. This leads to an inflating and thus to the complete opening of the carrier bag 2. Concerning this step, the bag base 6, which is folded over to the front and rear wall 4*a*, 4*b*, is also folded out (see also FIGS. 6 and 7).

FIGS. 4*a* and 4*b* show a first alternative embodiment of an active means mechanism 52.2 compared to the blow air system 58.1 according to FIG. 3. This mechanism includes an inflatable balloon 57 which is held on a rod link. Subsequently to the first opening step, the inflatable balloon 57 is introduced through the bag opening 18 into the bag interior 5 by way of a rod link and is inflated (see movement arrow), for the purpose of carrying out the second opening step. The bag walls 4*a*, 4*b*, 7*a*, 7*b* are displaced outwards by way of the inflating of the balloon 57 and the carrier bag 2 is completely opened or unfolded. The inflatable balloon 57 is pulled out of the bag interior 5 again after the complete opening of the carrier bag 2 (see movement arrow).

FIGS. 5*a* and 5*b* show a second alternative embodiment of an active means mechanism 52.3 compared to the blow air system 58.1 according to FIG. 3. This includes an opening plunger 63, which at its free end includes rollers 64, which can be pivoted out laterally. Subsequently to the first opening step, the opening plunger 63 is introduced with folded-in rollers 64 through the bag opening 18 into the bag interior 5 (see movement arrows), for the purpose of carrying out the second opening step.

The opening plunger 63 is now led with the rollers 64 towards the bag base 6. As soon as the opening plunger 63 has reached its opening position in the bag interior 5, the rollers 64 are pivoted out laterally, by which means the bag front wall and bag rear wall 4*a*, 4*b* are pressed outwards and the bag base 6 is folded out and the carrier bag 2 is folded open. The rollers 64 are pivoted laterally in the proximity of the base 6 so that the unfolding of the bag base 6 can indeed be effected in a reliable manner.

FIG. 6 shows an alternative blow air system 58.2 compared to the blow air system 58.1 according to FIG. 3, with a multitude of blow air openings, via which blow air can be blown in downwards through the bag opening 18 into the bag interior 5. A precise alignment or positioning of the blow air openings above the bag opening 18, as is the case in the embodiment example according to FIG. 3, is not necessary due to the multitude of blow air openings.

The conveying units are moved out of the opening region 66 by way of the conveying screw 61 subsequently to the opening and the transfer of the opened carrier bags 2 to the loading and transport containers 3, and are conveyed in the conveying direction F along the closed conveying stretch back into the transfer region 13.

FIG. 7 shows an alternative embodiment of the conveying unit for the first conveying appliance, compared to the conveying unit according to FIG. 1.

The conveying unit includes a schematically represented conveying vehicle 32, as is also represented in the embodiment example according to FIGS. 1 and 2. In contrast to the mentioned embodiment example, the holding means however is a holding hook 38, on which the carrier bag 2 is suspended via a carrier handle 8.

FIG. 8 shows the handling of the loading and transport containers 3 in combination with the supply of opened carrier bags 2 according to the present invention.

What is represented is a feed conveyor 71 for feed conveying empty loading and transport containers 3 to a merging appliance 70. The feed conveyer 71 forms a conveying surface for the loading and transport containers 3 in the form of a roller support.

The feed conveyor 71 forms an accumulation stretch for holding back empty loading and transport containers 3 upstream of the merging appliance 70. The empty loading and transport containers 3 are individually fed to the merging appliance 70 by way of a release station 72.

Individual, empty loading and transport containers 3 are conveyed in the conveying direction G onto a support member 73 of the merging appliance 70 for bringing the carrier bags 22 into the loading and transport containers 3. In the present embodiment example, the support member 73 is designed as a conveying belt and permits the active conveying of the loading and transport container 3 on the support member 73.

The support member 73 is coupled onto a lever mechanism 74, by way of which this together with the loading and transport container 3 can be lifted to the opening region 66 of the bag opening appliance 50 for the purpose of receiving carrier bags 2, and lowered again.

The lifting mechanism 74 is designed as a pivoting arrangement, by way of which the support member 73, pivoting about a pivot axis 76, can be lifted to the bag opening appliance 50. A lift member 75 with a lift cylinder is arranged below the support member 73 for carrying out the pivoting movement, the lift cylinder being designed to lift the support member 73 from below and to lower it again (double arrow).

The support surface of the support member 73 has an inclination in the initial position, in which the empty loading and transport containers 3 are moved from the feed conveyor 71 onto the support member 73 and in which loading and transport containers 3 with carrier bags 2 are transferred from the support member 73 onto the second conveying appliance 80.

The support surfaces of the feed conveyor 71 and of the second conveying appliance 80 are likewise inclined and are flush, which is to say aligned with the support surface of the support member 73. The descent of the inclined support surfaces is towards the conveying direction G, so that the loading and transport containers 3 can be conveyed in the conveying direction G on the roller support of the feed conveyor 71 or of the second conveying appliance 80 in a manner assisted by gravity.

The support member 73, by way of the lifting mechanism and with this the loading and transport container 3 on the support member 73, is lifted upwards towards the opening region 66 for the purpose of bringing the still flatly folded-together carrier bags 2 into the loading and transport container 2 in the opening region 66 of the bag opening appliance 50.

In this manner, the carrier bags 2 are positioned with their previously freely suspended base-side bag section in the loading and transport container 3 in the opening region 66.

The carrier bags 2 are subsequently completely opened in the loading and transport container 3 by way of the two-step opening method, which has already been described above.

After opening the carrier bags 2, these are released again from the suction grippers 53, 55 and the support member 73 is lowered again by way of the lifting mechanism 74. Accordingly, the loading and transport containers 3 together with the carrier bags 2, which are opened therein, are lowered out of the opening region 66 back into the initial position.

The second conveying appliance 80 is a roller conveyor with a roller support 81 for the loading and transport containers 3. As soon as the support member 73 has assumed its initial position again, the loading and transport containers 3 with the opened carrier bags 2, which are contained in these, are moved onto the roller support 81 of the second conveying appliance 80 by way of the conveying belt of the support member 73 and subsequently conveyed further with the second conveying appliance 80, e.g. along an order-picking stretch.

FIGS. 9*a* to 9*d* show a conventional carrier bag 2 as is common with regard to the transport of purchase and can be used in the present invention.

The carrier bag 2 includes a bag front wall 4*a*, a bag rear wall 4*b* as well as two bag side walls 7*a*, 7*b*. The bag side walls 7*a*, 7*b* form the short sides of the carrier bag 2. The carrier bag 2 further includes a bag opening 18, which leads into the bag interior 5. The bag opening 18 serves for filling the carrier bag 2 with goods 1.

The carrier bag 2 further includes two carrier handles 8 for carrying the carrier bag 2, of which a first carrier handle 8 is fastened to the bag front wall 4*a* and a second carrier handle 8 is fastened to the bag rear wall 4*b*. The carrier handles 8 can be folded over into the bag interior (see FIG. 9*b*).

The carrier bag 2 further includes a bag base 6, which in the folded-together state of the carrier bag 2 is folded over to the bag front wall 4*a* or bag rear wall 4*b* (see FIGS. 4*a* to 4*c*).

Longitudinally running fold lines 9, along which the carrier bag 2 can be folded together are arranged in the bag side walls 7*a*, 7*b*.

FIGS. 10 to 12 represent further embodiments of carrier bags 90, 91, 92. The carrier bags 90, 91, 92 each likewise form an upwardly facing bag opening and can be flatly folded together.

The carrier bag 90 according to FIG. 10 is designed as a folding bag analogously to the carrier bag 2 according to FIGS. 9*a* to 9*d*. However, the carrier bag 90 includes no carrier handles but grip openings 93, which are each arranged in the upper bag section in the bag front wall and the bag rear wall.

The carrier bag 91 according to FIGS. 11*a* and 11*b*, analogously to the carrier bag 90 according to FIG. 10, likewise includes grip openings 93 for holding the carrier bag 91. However, the carrier bag 91 is not a folding bag with fold lines in the bag side walls. In contrast, the carrier bag 91 includes a bag front wall and a bag rear wall, which are connected to one another via connections seams.

The carrier bag 92 according to FIG. 12 includes a bag front wall 94*a*, a bag rear wall 94*b* as well as bag side walls 95*a*, 95*b*, which connect these. The bag side walls 95*a*, 95*b* are each designed as a fabric mesh.

The second conveying appliance 40 according to the embodiment example according to FIG. 13 is designed as a suspended conveyor 40.

The suspended conveyor 40 includes holding means in the form of transport gratings (grids) 41, which are each connected to the conveying member 45 via a rod linkage 44. The transport gratings 44 each form a carrier base 42, on which a transport container 43 with the opened carrier bags 2, which are contained therein lie in the suspended conveying. The transport gratings 41 further form a support railing for the lateral support of the transport containers 43.

The conveying member 45, which is not represented in more detail in FIG. 13, can be a conveying vehicle, which, via rollers, rolls along a conveying rail, which is likewise not represented in more detail. The conveying rail runs along a conveying stretch H, which symbolically also indicates the guide rail.

As indicated in FIG. 13, the conveying vehicle 45 in particular includes two vehicle bodies that are arranged one after another and are spaced from each other along the conveying direction F, resp. in the longitudinal direction of the rail. The vehicle bodies are connected with each other via a strut body, such as a connection brace. The two vehicle bodies in each case contain in particular at least one runner roller (not shown), via which the conveying vehicles 45 roll along the conveying rail (not shown).

The FIG. 14 shows a facility 46 for order picking of goods 1 in carrier bags 2 by means of a conveying appliance 40 according to FIG. 13. The facility 46 further contains a plurality of delivery stations A, B, N−1, N for the delivery of goods 1 into the carrier bags 2 which are arranged along an order picking stretch K.

The conveying appliance 40 contains a plurality of transport containers 43 for receiving in each case three carrier bags 2 for the purpose of conveyance of the carrier bags 2 along the order picking stretch K. Of course, a different number of carrier bags 2 per transport container 43 possible.

The conveying appliance 40 is designed as a suspended conveyor (overhead conveyor), by means of which the carrier bags 2 which are arranged in the transport containers 43 are conveyed along the order picking stretch K past the individual delivery stations A, B, N−1, N in a indirect hanging manner.

At the delivery stations (A, B, N−1, N), which are only shown symbolically, the goods 1 are delivered from above through the bag opening into the individual carrier bags 2. It is not mandatory that at an individual delivery station (A, B, N−1, N) all carrier bags 2 of a transport container 43 have to be fed with goods 1.

The invention claimed is:

1. A method for the automated opening of a carrier and for provision of the carrier in a container-like loading and transport aid and for further conveying the opened carrier, comprising the steps of:

feeding the flatly closed carrier to a holder of a first suspended conveyor appliance by way of a carrier feed appliance;

conveying the flatly closed carrier, which is held by the holder, to a carrier opening appliance in a suspended manner;

opening the flatly closed carrier with the carrier opening appliance; and positioning the carrier in a standing manner in the container-like loading and transport aid with a merging appliance;

conveying away of the container-like loading and transport aid and the opened carrier with a second suspended conveyor appliance, wherein the second suspended conveyor appliance contains a conveying member onto which the container-like loading and transport aid is connected via a suspension, so that the container-like loading and transport aid together with the carrier being arranged in the container-like loading and transport aid in a standing manner can be further conveyed in a suspended manner.

2. The method according to claim 1, wherein the flatly closed carrier is folded together in a flat manner.

3. The method according to claim 1, wherein the carrier is a carrier bag.

4. The method according to claim 1, wherein the flatly closed carrier is separated from a stack and transferred onto the holder with a suction gripper.

5. The method according to claim 1, wherein the holder is conveyed into a transfer region in a controlled manner via a supply unit to take over the flatly closed carrier.

6. The method according to claim 1, wherein the holder, with the flatly closed carrier, is conveyed into the carrier opening appliance in a cycled manner via a pacer.

7. The method according to claim 1, wherein, in a first opening step, two carrier walls, which lie opposite one another, are separated and, in a second opening step, the carrier is completely opened by way of an active means, which acts into an interior of the carrier.

8. The method according to claim 7, wherein at least one suction gripper is moved towards an outer side of the two carrier walls, which lie opposite one another, and the carrier walls are each gripped at the outer sides by the suction grippers, and the suction grippers are spaced from one another amid the pulling-apart of the carrier walls.

9. The method according to claim 1, wherein the carrier is brought into the container-like loading and transport aid in the flatly closed state.

10. The method according to claim 1, wherein the flatly closed carrier is opened in the suspended position.

11. The method claim 1, wherein, in a first opening step, two carrier walls, which lie opposite one another are separated by way of suction grippers.

12. The method according to claim 1, wherein the carrier is transferred from the holder of the first conveying appliance onto the container-like loading and transport aid by way of a separating mechanism.

13. The method according to claim 1, wherein the container-like loading and transport aid is moved upwards to the carrier, which is held in the carrier opening appliance in a suspended manner, by way of the merging appliance, and the carrier is thus brought into the container-like loading and transport aid.

14. The method according to claim 1, wherein the container-like loading and transport aid with the opened carrier, which is brought into the container-like loading and transport aid, is transferred to the second conveying appliance for further conveying.

15. A facility for the automated opening of a carrier and for supplying the carrier in a container-like loading and transport aid and for further conveying the opened carrier, comprising:

a carrier feed appliance for feeding the flatly closed carrier from a stack to a holder of a first suspended conveyor appliance;

the first suspended conveyor appliance for the suspended conveying of the flatly closed carrier, which is held by a holder, to a carrier opening appliance;

the carrier opening appliance for opening the flatly closed carrier;

a merging appliance for positioning the carrier in a standing position in the container-like loading and transport aid;

a second suspended conveyor appliance for conveying away the container-like loading and transport aid with the opened carrier, which is arranged in the container-like loading and transport aid in a suspended manner, wherein the second suspended conveyor appliance contains a conveying member onto which the container-like loading and transport aid is connected via a suspension, so that the container-like loading and transport aid together with the carrier being arranged in the container-like loading and transport aid in a standing manner can be further conveyed in a suspended manner.

16. The facility according to claim 15, wherein the holder is a gripper.

17. The facility according to claim 15, wherein the holder is arranged on a conveying member that is movable along a conveying stretch.

18. The facility according to claim 17, wherein the conveying member is a conveying vehicle with runner rollers, which are movable along a guide rail.

19. The facility according to claim 15, wherein the carrier opening appliance comprises a separating mechanism for separating two carrier walls, which lie opposite one another.

20. The facility according to claim 19, wherein the separating mechanism comprises at least one first suction gripper for gripping a first carrier wall and at least one second suction gripper for gripping an opposite second carrier wall.

21. The facility according to claim 15, wherein the carrier opening appliance comprises an active mechanism with an active means that acts into an interior of the carrier to completely open the carrier.

22. The facility according to claim 21, wherein the active mechanism is a blow air system for blowing air as an active means into the carrier interior.

23. The facility according to claim 21, wherein the active mechanism includes an active body that can be introduced into the carrier interior.

24. A facility for order picking of goods into carriers, comprising a suspended conveyor appliance with a plurality of container-like loading and transport aids for receiving the carriers in a standing manner and with conveying members onto which the container-like loading and transport aids are connected via suspensions for conveying the container-like loading and transport aids together with the carriers being arranged in the container-like loading and transport aids in a standing manner along an order picking stretch in a suspended manner, further comprising a plurality of delivery stations arranged along the order picking stretch for delivery of goods into the standing carriers.

25. The facility according to claim 24, wherein each of the container-like loading and transport aids receive several carriers.

* * * * *